United States Patent [19]

Wernicke et al.

[11] 4,348,475

[45] Sep. 7, 1982

[54] PROCESS FOR THE PRODUCTION OF PHOTOGRAPHIC IMAGES

[75] Inventors: Ubbo Wernicke, Odenthal; Heinz Meckl, Bergisch Gladbach, both of Fed. Rep. of Germany

[73] Assignee: Agfa-Gevaert Aktiengesellschaft AG, Leverkusen, Fed. Rep. of Germany

[21] Appl. No.: 143,152

[22] Filed: Apr. 23, 1980

[30] Foreign Application Priority Data

Apr. 26, 1979 [DE] Fed. Rep. of Germany ..... 2916836

[51] Int. Cl.[3] ..... G03C 5/30

[52] U.S. Cl. ..... 430/399; 430/434; 430/442; 430/467

[58] Field of Search ..... 430/398, 399, 357, 375, 430/376, 434, 442, 467

[56] References Cited

U.S. PATENT DOCUMENTS

| | | | |
|---|---|---|---|
| 2,073,621 | 3/1937 | Blaney | 430/399 |
| 3,253,920 | 5/1966 | Rees | 430/399 |
| 3,627,530 | 12/1971 | Umberger | 430/363 |
| 4,159,245 | 6/1979 | Matsushita | 430/399 |
| 4,163,023 | 7/1979 | Endo | 430/399 |

FOREIGN PATENT DOCUMENTS

| | | | |
|---|---|---|---|
| 709179 | 5/1954 | United Kingdom | 430/399 |

*Primary Examiner*—Mary F. Downey
*Attorney, Agent, or Firm*—Connolly and Hutz

[57] ABSTRACT

In a process for the production of photographic images exposed photographic materials are treated with a developer having an enhanced bromide ion concentration which is kept constant for the duration of the use of the developer. The advantage of the process is based on the technically uncomplicated regenerability of the developer.

1 Claim, No Drawings

PROCESS FOR THE PRODUCTION OF PHOTOGRAPHIC IMAGES

The invention relates to an improved process for the production of photographic images. The invention relates in particular to an improved reversal process for the production of color photographic images using materials which contain at least one silver halide emulsion layer.

It is known that in the customary techniques for the photographic development of materials containing silver halide emulsions, halide ions are released, which diffuse out of the photographic material into the developer and accumulate there.

It is known that development can be severely hindered in the presence of halide ions, particularly in the presence of bromide ions or iodide ions. Therefore, efforts are generally made to keep the halide content as low as possible in the developer.

In the usual color developers, the concentration of the bromide ions thus corresponds to not more than 0.6–1.5 g KBr per liter. It is necessary to keep the chosen bromide ion concentration constant during the development process (J. H. Priesthoff, Journal of the SMPTE, 65 (1956) 478).

In order to achieve this, it is known to add a regenerator which is substantially free from halide to the developer. The quantity of the regenerator which is necessary for this, which contains the chemicals necessary for the regeneration of the developer, is however substantially higher than the stoichiometric requirement and is equivalent to removing the developer chemicals from the developer during development. Thus, a process of this kind is uneconomical.

Furthermore, it is known from British Patent Specification No. 835,556, to use ion exchange resins for the preparation of developers. These remove the interfering halide ions from the developer, so that a used developer which has been treated with the ion exchange resin can be used again as a basis for a regenerator. A disadvantage of the process known from British Patent Specification No. 835,556 is however the fact that under the conditions specified, relatively few bromide ions are bound by the ion exchange resin. In order to absorb the relatively high quantities of halide, released from the photographic material during development large quantities of ion exchange resin must therefore be used which, for reasons of economy have to be regenerated in a complicated process. Another disadvantage of the process which has an interfering effect—particularly with larger quantities of ion exchange resins—is that these ion exchange resins also combine with the developer substances contained in the developer as well as with other substances. The loss of developer substance leads to a continuous variation in the absorptivity of the ion exchange resins for halide ions and consequently leads to a variable bromide ion content in the treated developer. This makes continuous analytical control necessary as well as corresponding corrections.

Therefore, an object of the invention was to provide a process for the development of photographic images, in which process the developers required can be regenerated economically and without any significant technical efforts and can optionally be used again.

In particular, the aim was to considerably increase the efficiency of the ion exchange resins; however two tasks had first of all to be fulfilled, both of which at first seemed to be technically almost impossible to achieve increased efficiency of the ion exchange resins upon absorbing ions from developer solutions, with, at the same time, reduced losses of the developer substances themselves.

A process for the production of photographic images has now been found, in which an exposed photographic material which contains at least one silver halide emulsion layer, is treated with a developer and which process is characterised in that:

(a) the developer has a bromide ion concentration which is considerably higher than the normal concentration and which is, for example, twice or three times as high as the usual concentration.

(b) the bromide ions concentration of this developer can be kept substantially or completely constant without analytical control.

Suitable bromide ion concentrations are at least 3 g KBr per liter of the developer, preferably at least 6 g KBr per liter and, in a particularly preferred embodiment, are at least 10 g KBr per liter. The bromides are generally used in the form of alkali metal bromides. If the said color developers are mainly used for developing photographic materials having a very small layer thickness and/or a very thin silver coating, the said equilibrium concentrations of bromide can be considerably lower, they are still however at least twice or three times as high as the usual concentrations.

The processes used in regulating the bromide ion concentration of the developer correspond to those known per se. For example membrane-separation processes can be used.

In a particularly preferred embodiment, ion exchangers are used for regulating the bromide content of the developer. For this process, strongly basic ion exchangers based on styrene-divinyl benzene have proved to be particularly suitable, and are described for example in German Pat. No. 1,045,102.

The development kinetics of the developer which is to be used according to the invention can optionally be influenced by measures which are known per se so that they correspond to that of a customary developer which is low in bromide. For example, the following measures can be taken:

(a) The temperature of the developer may be increased;

(b) The duration of development may be increased;

(c) Development accelerators are added to the developer, particularly to the color developer, in reversal color processing.

For development, the usual color developing substances may be used, e.g.

N,N-dimethyl-p-phenylenediamine 4-amino-3-methyl-N-ethyl-N-methoxyethylaniline

Monomethyl-p-phenylenediamine 2-amino-5-diethylaminotoluene

N-butyl-N-$\omega$-sulfo-butyl-p-phenylenediamine 2-amino-5-(N-ethyl-N-$\beta$-methanesulfonamidoethylamino)toluene N-ethyl-N-$\beta$-hydroxyethyl-p-phenylenediamine N,N-bis($\beta$-hydroxyethyl)-p-phenylenediamine 2-amino-5-(n-ethyl-N-$\beta$-hydroxyethylamino)toluene and the like.

Other color developers which can be used are described for example in J. Amer. Chem. Soc. 73, 3100 (1951).

The process according to the invention can be applied to the processing of a light-sensitive photographic material which contains couplers. As couplers, the usual color couplers which are usually present in the silver halide layers themselves can be used. Thus, the red-sensitive layer contains for example a non-diffusing color for producing the cyan component of the color image, usually a coupler of the phenol or α-naphthol type. The green-sensitive layer contains at least one non-diffusing color coupler for producing the magenta component of the color image, for example color couplers of the 5-pyrazolone or indazolone type are generally used. Finally, the blue-sensitive layer contains at least one non-diffusing color coupler for producing the yellow component of the color image, generally a color coupler with an open-chain ketomethylene group. Color couplers of this kind are known in large numbers and are described in a number of Patent Specifications. See for example, the publication "Farbkuppler" by W. Pelz in "Mitteilungen aus den Forschungslaboratorien der Agfa, Leverkusen/Munchen", Band III (1961) and K. Venkataraman in "The Chemistry of Synthetic Dyes", Vol. 4, 341–387, Academic Press, 1971.

2-Equivalent couplers can be used as non-diffusable color couplers; these contain in the coupling position a substituent which can be split off so that they require two equivalents of silver halide for color formation, in contrast to the usual 4-equivalent couplers.

The 2-equivalent couplers which can be used include for example the known DIR-couplers in which the radical, which can be split off after reaction with color developer oxidation products, is released as a diffusible development inhibitor. Moreover, so-called white couplers can be used to improve the properties of the photographic material.

The non-diffusible color couplers and color-producing compounds are added to the light-sensitive silver halide emulsions or to other casting solutions using known methods. Where water-soluble compounds or alkali-soluble compounds are concerned, they can be added to the emulsions in the form of aqueous solutions to which water-miscible organic solvents such as ethanol, acetone or dimethyl formamide may be added. If the non-diffusible color couplers and color-producing compounds are non-water-soluble or non-alkali-soluble compounds, they can be emulsified in a known way, e.g. by mixing a solution of these compounds in a low-boiling organic solvent directly with the silver halide emulsion or firstly with an aqueous gelatine solution, whereupon the organic solvent is removed in a conventional way. A gelatine emulsion of the appropriate compound obtained in this way is then mixed with the silver halide emulsion. Addition so-called coupler solvents or oil-formers may also be used for emulsifing such hydrophobic compounds; these are usually higher-boiling organic compounds including, in the form of oily droplets, the compounds which release the non-diffusible color couplers and development inhibitors to be emulsified in the silver halide emulsions. Reference is made in this context for example to U.S. Pat. Nos. 2,322,027; 2,533,514; 3,689,271 and 3,765,897.

The usual silver halide emulsions are suitable for the present invention. As silver halides, these may contain silver chloride, silver bromide, silver iodide or mixtures thereof. Gelatine is preferably used as the binder for the photographic layers. However, this can be completely or partially replaced by other natural or synthetic binders. Suitable natural binders include e.g. alginic acid and its derivatives such as salts, esters or amides, cellulose derivatives such as carboxy methyl cellulose alkyl cellulose such as hydroxy ethyl cellulose, starch or its derivates such as ethers or esters or caragenates. Synthetic binders include polyvinyl alcohol, partially saponified polyvinyl acetate, polyvinyl pyrrolidone and the like.

The emulsions can also be chemically sensitized, e.g. by adding compounds containing sulfur during chemical ripening, for example allyl isothiocyanate, allyl thiourea, sodium thirosulfate and the like. Furthermore, reducing agents can also be used as chemical sensitizers, e.g. the tin compounds described in Belgium Pat. Nos. 493,464, or 568,687 and polyamines such as diethylene triamine or amino methane sulfinic acid derivatives, for example, according to Belgium Pat. No. 547,323.

Suitable chemical sensitizers also include precious metals such as gold, platinum, palladium, iridium, ruthenium or rhodium, as well as compounds of these metals. This method of chemical sensitization is described in the article by R. Koslowsky, Z. Wiss Phot., 46,65–72 (1951).

It is also possible to sensitize the emulsions with polyalkylene oxide derivatives, for example with polyethylene oxide having a molecular weight of between 1000 and 20,000, and with condensation products of alkylene oxides and aliphatic carboxylic acids, aliphatic amines, aliphatic diamines and amides. The condensation products have a moleuclar weight of at least 700, preferably of more than 1000. These sensitizers can naturally be combined to obtain special effects, as is described in Belgium Pat. No. 537,278 and British Pat. No. 727,982. The emulsions can also be sensitized spectrally for example with the usual monomethine or polymethine dyes, such as acidic or basic cyanines, hemi-cyanines; streptocyanines; merocyanines; oxonoles; hemioxononles; styryl dyes or others, also tri nuclear or polynuclear methine dyes, for example rhodacyanes or neocyanines. Sensitisers of this kind are described for example in the book by F. M. Hamer "The Cyanine Dyes and Related Compounds" (1964), Interscience Publishers, John Wiley and Sons, New York. The emulsions can contain the usual stabilizers, for example homopolar or salt-like compounds of mercury with aromatic or heterocyclic rings such as mercapto triazoles, simple mercury salts, sulfonium mercury double salts and other mercury compounds. Other suitable stabilizers include azaindenes, preferably tetraazaindene or penta azaindene, in particular those which are substituted with hydroxyl groups or amino groups. Compounds of this kind are described in the article by Birr, Z. Wiss. Phot. 47, 2–58 (1952). Other suitable stabilizers are heterocyclic mercapto compounds, for example, phenylmercaptotetrazole, quaternary benzothiazole derivatives benzotriazole and the like.

The emulsions can be hardened in the usual way, for example with formaldehyde or halogen-substituted aldehydes, which contain a carboxyl group such as mucobromic acid, diketones, methane sulphonic acid esters, dialdehydes and the like. In addition, the photographic layers can be hardened with hardeners of the epoxy, heterocyclic ethylene imine or acryloyl type. Examples of such hardeners are described for example in German Offenlegungsschrift No. 2,263,602 or in British Pat. No. 1,266,655. Furthermore, it is also possible to harden the layers by the process described in German Offenlegungsschrift No. 2,218,009 in order to obtain color photographic materials which are suitable for high temperature processing.

It is also possible to harden the photographic layers or rather the color photographic multi-layer materials using diazine, triazine, or 1,2-dihydroquinoline hardeners, as described in the British Pat. Nos. 1,193,290; 1,251,091; 1,306,544 and 1,266,655; French Patent No. 71, 02 716 or German Patent Application P 23 32 317.3 (A-G 1110). Examples of such hardeners include diazine derivatives containing alkyl or aryl sulphonyl groups, derivatives of hydrated diazines or triazines such as 1,3,5-hexahydrotriazine, fluorine-substituted diazine derivatives such as for example fluoropyrimidine; esters of 2-substituted 1,2-dihydroquinoline or 1,2-dihydroisoqinoline-N-carboxylic acids. Vinyl sulfonic acid hardeners, carbodiimide or carbamoyl hardeners can also be used, as described for example in German Offenlegungsschrift Nos. 2,263,602, 2,225,230 and 1,808,685; French Pat. No. 1,491,807; German Pat. No. 872,153 and German Democratic Republic Pat. No. 7218. Other hardeners which can be used are described, for example in British Pat. No. 1,268,550.

The usual substrates are used. Suitable substrates are for example foils of cellulose nitrate, cellulose acetate such cellulose triacetate, polystyrene, polyester such polyethylene terephthalate, polyolefines, such as polyethylene or polypropylene, a baryta paper substrate or a paper substrate covered with a polyolefine, for example polyethylene, glass and the like.

The process according to the invention is particularly suitable for the color development of photographic materials. For example, an imagewise exposed photographic reveresal material with at least one silver halide emulsion layer is subjected to a black and white development and optionally to other intermediate baths. Then, the photographic material is fogged in a known way and the photographic material process in this way is developed in a second developer (color developer) according to the invention with the formation of a positive reversal image.

The advantages of the process according to the invention are based not only on the simple operation of regeneration of the used developer but also on the considerable diminution of the volumina required. Thus, no complicated apparatus is required for regeneration of the used developer and only comparatively small amounts of ion exchange resins are necessary because of the increased absorptivity of the ion exchange resin.

If a potassium bromide concentration of 10 g per liter in a used developer is to be lowered to, for example, 8 g per liter of potassium bromide, then according to the invention approximately only 1 kg ion exchange resin per 100 l of developer is necessary, while approximately 10 kg of ion exchange resin are necessary for removing the same amount of bromine from a developer having a content of 2 g potassium bromide per liter, under otherwise the same conditions.

With the process according to the invention, by treating a used developer with small amounts of an ion exchange resin a constant and reproducible developer composition is obtained, which can be re-used as a regenerator after the addition of necessary supplementary chemicals (rejuvenator).

It was indeed known from U.S. Pat. Nos. 3,183,087 and 3,523,793 to use developers having a high bromide content for the development of reversal materials. In both cases, however, the developer are quite specific black and white developers with which no color development takes place.

A rapid development process is known from U.S. Pat. No. 3,627,530, in which developers having a higher bromide content are used. The developers known from this Patent Specification, having a high bromide content are used for rapid processing methods. They are not suitable for other processing methods.

The advantages of the process according to the invention in comparison with the known processes are all the more surprising since it is known from German Offenlengungsschrift No. 2,226,771, that bromides in high concentrations impair the development of photographic materials.

The process according to the invention is explained in the following examples.

EXAMPLE 1

1 liter of a color developer which is suitable for reversal development, having a potassium bromide content of 2 g was mixed with 10 g of a strongly basic anion exchange resin based on styrene-divinyl benzene according to German Pat. No. 1,045,102 and the mixture was stirred for two hours. The developer then filtered off from the anion exchange resin. The bromide ion concentration in the filtrate can been seen from table 1. The color developer which was used has the following composition per liter:

| | |
|---|---|
| Ethylenediaminetetraacetic acid | 2g |
| Disodium salt of 1-hydroxy-ethane-1,1-diphosphonic acid | 2g |
| Tri-sodium phosphate sicc. | 60g |
| Sodium sulfite | 5g |
| 4-amino-3-methyl-N-ethyl-N-(β-hydroxy-ethyl)-aniline | 5g |
| Potassium bromide | 2g |
| Sodium hydroxide | 2.4g |
| Hydroxylamine | 1g |
| Poly-1-(2-hydroxyethylmercapto)-propylenoxide | 2.5g |
| pH-Value 12.1 | |

EXAMPLE 2

The process was carried out as in example 1, but a KBr-content of 10 g per liter was introduced into the color developer. The KBr-content in the filtrate after treatment with the anion exchange resin can be seen from Table 1.

TABLE 1

| Example | Initial Concentration (KBr/l) | Final Concentration (KBr/l) | Δ (KBr/l) |
|---|---|---|---|
| 1 | 2.00 | 1.70 | 0.30 |
| 2 | 10.00 | 9.05 | 0.95 |

It can therefore be seen that with the process according to the invention (example 2) using the same amount of anion exchange resin, a substantially greater amount of potassium bromide is absorbed by the anion exchanger.

EXAMPLE 3

A photographic material, having the structure shown as follows, was imagewise exposed in the usual way and was treated by the reversal process described:

Structure of the photographic material

Layer 1: Cyan layer, containing a silver bromo-iodide emulsion with 7% mole of iodide, produced according to Glafkides "Photographic Chemistry", Vol 1. page 289 ff, Fountain Press, London 1958. The silver content of the emulsion—expressed as $AgNO_3$—amounted to 100 g per kg emulsion. The emulsion was ripened in known manner by adding sulfur compounds and gold-1-compounds. It was sensitized to the red spectral range and contained a color coupler of the following formula:

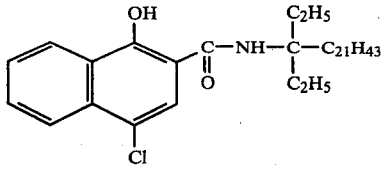

Layer 2: A second cyan layer, containing a silver bromo-iodide emulsion with 6% mole of iodide, produced according to the process described under layer 1, but having a higher sensitivity. The layer contained the same color coupler as layer 1.

Layer 3: Magenta layer containing a silver bromo-iodide emulsion as described in layer 1, but sensitized to the green spectral range. It contained a coupler corresponding to the following formula:

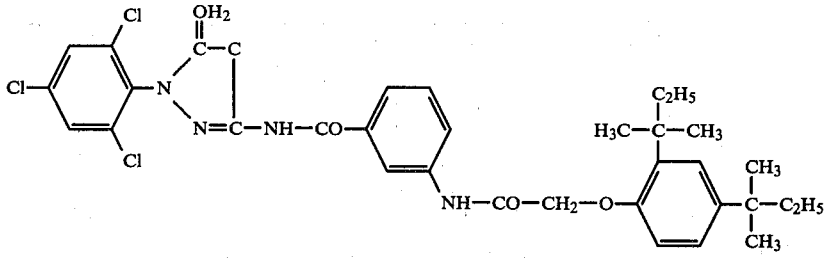

Layer 4: A second magenta layer containing an emulsion as described under layer 2 but sensitized to the green spectral range and with the same coupler as layer 3.

Layer 5: Yellow filter layer composed of a silver sol.

Layer 6: A yellow layer containing a silver bromo-iodide emulsion containing 4% mole of iodide, produced as described under layer 1, which was sensitive to the blue spectral range. The layer contained a coupler corresponding to the following formula:

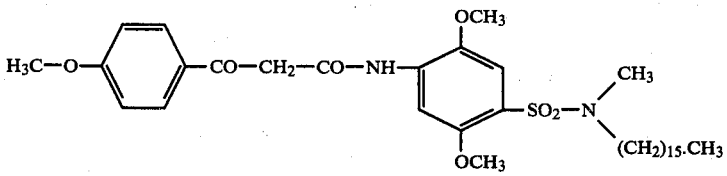

Layer 7: A second yellow layer, containing a silver bromo-iodide emulsion with 6% mole of iodide, produced as described under layer 1, but with a high sensitivity in the blue spectral range than layer 6. The layer contained the same color coupler as layer 6.

Layer 8: The structure was sealed with a protective layer. The casting solution used for this layer contained 1.6% of gelatine in addition to the hardening and wetting agents. The application corresponded to 50 ml per sq meter.

Processing I

The imagewise exposed material was developed for 8 minutes at 30° C. in the following first developer I. The photographic material was subsequently subjected to a stop bath, rinsed, exposed for a second time and developed for 6 minutes in developer II at 30° C. After a second development it was bleached in the usual way and fixed, rinsed, and dried. Developer II has the same composition as the developer described in example 1.

Developer I (Concentration per liter)

| | |
|---|---|
| Ethylenediaminetetraacetic acid | 2 g |
| Soda sicc. | 27.5 g |
| Sodium sulfite sicc. | 50 g |
| 1-Phenyl-3-pyrazolidone | 0.3 g |
| Hydroquinone | 6 g |
| Potassium rhodanide 50% | 5 ml |
| Potassium bromide | 2 g |
| Sodium bicarbonate | 6 g |
| Potassium iodide (0.1% aqueous solution) | 15 ml |
| pH-Value: 10.0 | |

Processing II

This was carried out in the same way as described under processing 1 with the following alteration: Developer II contained 10 g potassium bromide; Duration of second development: 10 minutes at 30° C.

Processing III

This was carried out in the same way as described under processing 1 with the following alteration: Developer II contained 10 g potassium bromide; Duration of the second development: 6 minutes at 38° C.

Processing IV

This was carried out in the same way as described under processing 1, with the following alteration: Developer II contained 20 g potassium bromide; Duration of the second development: 6 minutes at 78° C.

The following maximum densities are obtained:

TABLE 2

| Processing | KBr (g/l) | T (°C.) | t (min) | $D_{max}$ yellow | magenta | cyan |
|---|---|---|---|---|---|---|
| I (Comparison) | 2 | 30 | 6 | 3.72 | 3.90 | 3.45 |
| II | 10 | 30 | 10 | 3.52 | 4.02 | 3.45 |
| III | 10 | 38 | 6 | 3.64 | 3.95 | 3.43 |
| IV | 20 | 78 | 6 | 3.57 | 4.12 | 3.57 |

As can be seen from the comparison of the processing methods I to IV, using the process according to the invention (II to IV), practically the same maximum densities are obtained or even exceeded in comparison with the processing according to the known method. The advantage of the process according to the invention as against the comparison process (I) is—as can be seen from example 1—that the regeneration of the used developer is much simpler and more economical.

We claim:

1. A photographic development process which comprises processing exposed multi-layer color photographic material under development conditions to produce images of maximum density with a color developer composition having an effective bromide ion concentration equivalent to at least in excess of ten grams of potassium bromide per liter of color developer including the step of maintaining the said bromide ion concentration in said developer at a substantial constant by removing bromide ion from the developer by contacting the developer with a strongly basic ion exchange resin based on styrene-divinyl benzene and thereby removing bromide ions.

* * * * *